US006848680B2

(12) United States Patent
Schmitz

(10) Patent No.: US 6,848,680 B2
(45) **Date of Patent: *Feb. 1, 2005**

(54) PUSH BUTTON AIR PRIMER FOR CARBURETOR

(75) Inventor: Phillip R. Schmitz, Malone, WI (US)

(73) Assignee: Tecumseh Products Company, Tecumseh, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/400,360

(22) Filed: Mar. 27, 2003

(65) Prior Publication Data

US 2004/0188865 A1 Sep. 30, 2004

(51) Int. Cl.[7] ..... F02M 1/16

(52) U.S. Cl. ..... 261/35; 123/179.11; 261/DIG. 8; 261/DIG. 67

(58) Field of Search ..... 261/35, DIG. 8, 261/DIG. 67, DIG. 73; 123/179.11

(56) References Cited

U.S. PATENT DOCUMENTS

| | | | | | |
|---|---|---|---|---|---|
| 1,183,183 | A | * | 5/1916 | Funderburk | 261/41.1 |
| 3,177,920 | A | | 4/1965 | Phillips | 123/179.11 |
| 3,307,836 | A | | 3/1967 | Arndt et al. | 261/34 |
| 3,948,589 | A | | 4/1976 | DuBois | 417/487 |
| 3,978,839 | A | | 9/1976 | DuBois et al. | 123/179.11 |
| 4,228,110 | A | | 10/1980 | Magnet | 261/37 |
| 4,309,968 | A | | 1/1982 | DuBois | 123/179.11 |
| 4,411,844 | A | | 10/1983 | Morris et al. | 261/34.1 |
| 4,589,386 | A | | 5/1986 | Everts | 123/179.11 |
| 4,660,516 | A | | 4/1987 | Baltz et al. | 123/187.5 R |
| 4,747,760 | A | | 5/1988 | Eberl et al. | 417/443 |
| 4,926,808 | A | | 5/1990 | Kandler | 123/179.11 |
| 5,070,829 | A | * | 12/1991 | Guntly et al. | 123/179.9 |
| 5,071,325 | A | | 12/1991 | Tupper et al. | 417/496 |
| 5,664,532 | A | | 9/1997 | August | 123/179.11 |
| 5,711,901 | A | * | 1/1998 | Berg et al. | 261/35 |
| 5,740,781 | A | | 4/1998 | Scott et al. | 123/437 |
| 6,152,431 | A | | 11/2000 | Stenz et al. | 261/34.1 |
| 6,374,782 | B2 | * | 4/2002 | Ishikawa et al. | 123/73 AF |
| 6,561,495 | B2 | * | 5/2003 | Woody | 261/37 |
| 6,595,500 | B2 | * | 7/2003 | Osburg et al. | 261/34.2 |

FOREIGN PATENT DOCUMENTS

| | | | | |
|---|---|---|---|---|
| JP | 1-190954 | * | 8/1989 | 261/DIG. 8 |
| JP | 2-204668 | * | 8/1990 | 261/DIG. 8 |

* cited by examiner

*Primary Examiner*—Richard L. Chiesa
(74) *Attorney, Agent, or Firm*—Baker & Daniels

(57) ABSTRACT

A push button air primer is provided for a carburetor used with a small internal combustion engine. The carburetor includes a primer chamber having a piston sealingly and slidably movable therein, with a return spring biasing the piston outwardly of the carburetor. The piston is depressible by an operator such that, upon initial depression of the piston, a portion of the piston slides past a plurality of vent holes in the wall of the primer chamber to block communication between the primer chamber and an internal vent passage within the carburetor which leads to the carburetor throat and thence to the atmosphere. Thereafter, further depression of the piston reduces the volume of the primer chamber and forces a quantity of air from the primer chamber into the fuel bowl of the carburetor, thereby pressurizing the air space in the carburetor to force a quantity of liquid fuel into the throat of the carburetor to aid in engine starting.

21 Claims, 4 Drawing Sheets

PUSH BUTTON AIR PRIMER FOR CARBURETOR

BACKGROUND OF THE INVENTION

1. Field of the Invention

The present invention relates to carburetors for small internal combustion engines of the type used with lawn mowers, lawn tractors, sport vehicles, and other small working implements.

2. Description of the Related Art

Small internal combustion engines typically include a carburetor for providing an air/fuel combustion mixture to the engine. One type of carburetor commonly used in small engines includes a fuel bowl for storing fuel and a throat with a venturi region. Intake air is drawn through the throat to generate a reduced pressure in the venturi region, drawing fuel from the fuel bowl into the throat where the fuel mixes with the intake air to form the combustion mixture.

In order to start the engine, the carburetor must be primed so that an enriched air-fuel mixture is initially supplied to the engine. Typically, the air space in the fuel bowl is pressurized to force an amount of priming fuel from the fuel bowl directly into the throat to provide an enriched air/fuel mixture for engine starting.

One primer system includes a resilient primer bulb or bellows that, when manually depressed, increases the pressure in the fuel bowl, causing an amount of priming fuel to flow from the fuel bowl through a nozzle into the carburetor throat. In some of these systems, the primer bulb also serves as a check valve to seal off an internal vent passage within the carburetor, such that air within the primer bulb is directed only into the fuel bowl.

However, if the operator does not depress the primer bulb completely, the resulting pressure in the fuel bowl may be inadequate to cause a sufficient amount of fuel to flow into the throat. In addition, the primer bulb is most effective as a check valve when it is depressed directly inwardly toward the carburetor along a straight line. If the operator depresses the bulb at an angle, the bulb may not effectively seal off the internal vent passage, allowing air to leak into the internal vent passage such that the fuel bowl is not pressurized sufficiently to provide priming fuel to the carburetor throat in an amount effective for engine starting.

A number of other primer systems use a primer bulb to introduce liquid fuel directly into the carburetor throat. In these systems, fuel is drawn into the primer bulb when the primer bulb is depressed and then released. When the primer bulb is depressed again, the fuel contained in the primer bulb is forced from the primer bulb into the throat. This system poses similar disadvantages. If the primer bulb is not depressed completely, the fuel injected from the primer bulb to the throat may be insufficient to start the engine.

It is desired to provide a primer system for small engine carburetors that is an improvement over the foregoing.

SUMMARY OF THE INVENTION

The present invention provides a push button air primer for a carburetor used with a small internal combustion engine. The carburetor includes a primer chamber having a piston sealingly and slidably movable therein, with a return spring biasing the piston outwardly of the carburetor. The piston is depressible by an operator such that, upon initial depression of the piston, a portion of the piston slides past a plurality of vent holes in the wall of the primer chamber to block communication between the primer chamber and an internal vent passage within the carburetor which leads to the carburetor throat and thence to the atmosphere. Thereafter, further depression of the piston reduces the volume of the primer chamber and forces a quantity of air from the primer chamber into the fuel bowl of the carburetor, thereby pressurizing the air space in the carburetor to force a quantity of liquid fuel into the throat of the carburetor to aid in engine starting.

More specifically, in one embodiment, a carburetor is provided including a carburetor body having a fuel bowl storing a quantity of fuel, as well as a throat extending through the carburetor body, and a main fuel jet communicating the fuel bowl with the throat. The carburetor includes a primer chamber in communication with the fuel bowl, the primer chamber defined by an annular sleeve inserted within an annular wall of the carburetor body. An outer chamber is defined between the annular sleeve and the annular wall of the carburetor, the outer chamber in communication with an internal vent passage of the carburetor and thence to the atmosphere via the carburetor throat. The annular sleeve includes a plurality of vent holes which are spaced radially therearound with respect to the longitudinal axis of the primer assembly, the vent holes communicating the primer chamber with the outer chamber and the internal vent passage.

A piston is sealingly and slidably disposed within the primer chamber, and is biased outwardly of the carburetor toward a proximal end of the primer chamber by a return spring to a position in which the piston is disposed outwardly of the vent holes in the sleeve. A retaining assembly limits the outward extent of travel of the piston within the primer chamber. Upon initial depression of the piston against the bias force of the return spring toward a distal end of the primer chamber, an outer sealing portion of the piston slides past the vent holes, thereby blocking communication between the primer chamber and the outer chamber and internal vent passage. Thereafter, continued depression of the piston inwardly toward the carburetor forces air within the primer chamber into the fuel bowl of the carburetor, thereby pressurizing the air space in the fuel bowl and forcing a quantity of liquid priming fuel into the throat of the carburetor to aid in engine starting.

Advantageously, the piston is confined for slidable movement within the primer chamber along the longitudinal axis of the primer chamber. Specifically, the piston and annular sleeve of the primer chamber are made of substantially rigid components in close fitting engagement with one another, such that the sliding relationship therebetween restricts movement of the piston along the longitudinal axis of the primer chamber, reducing the potential for operator error during the priming operation. Thus, regardless of the particular direction from which the piston is depressed, the piston moves only along the longitudinal axis of the primer chamber to initially block the vent holes thereof, and subsequently to force air from the primer chamber into the fuel bowl.

In one form thereof, the present invention provides a carburetor, including a carburetor body having a throat therethrough; a fuel bowl containing a quantity of fuel, the fuel bowl in communication with the throat; an internal vent passage in communication with the throat; and a primer assembly, including a primer chamber in communication with the internal vent passage through at least one vent hole disposed at a proximal end of the primer chamber, the primer chamber also in communication with the fuel bowl at a distal end of the primer chamber; and a piston slidable within the primer chamber, whereby initial travel of the piston closes the at least one vent hole, and further travel of the piston displaces air from the primer chamber into the fuel bowl.

In another form thereof, the present invention provides a carburetor, including a carburetor body having a throat; a fuel bowl containing a quantity of fuel and an air space above the quantity of fuel, the fuel bowl in communication with the throat; and a primer assembly, including a primer chamber in communication with the fuel bowl air space; vent means for communicating the primer chamber with the throat; and piston means for closing the vent means and forcing air from the primer chamber into the fuel bowl air space. In a further form thereof, the present invention provides a method of priming a carburetor for starting an internal combustion engine, including the steps of depressing a piston assembly within a primer chamber in a direction from a proximal end to a distal end of the primer chamber to thereby move a portion of the piston assembly beyond a vent in the primer chamber to block communication between the primer chamber and an internal vent of the carburetor; and continuing depression of the piston assembly to force air within the primer chamber into a fuel bowl of the carburetor to pressurize the fuel bowl and thereby convey fuel from the pressurized fuel bowl to a throat of the carburetor.

BRIEF DESCRIPTION OF THE DRAWINGS

The above-mentioned and other features and advantages of this invention, and the manner of attaining them, will become more apparent and the invention itself will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention any manner.

DETAILED DESCRIPTION

Figure 1:
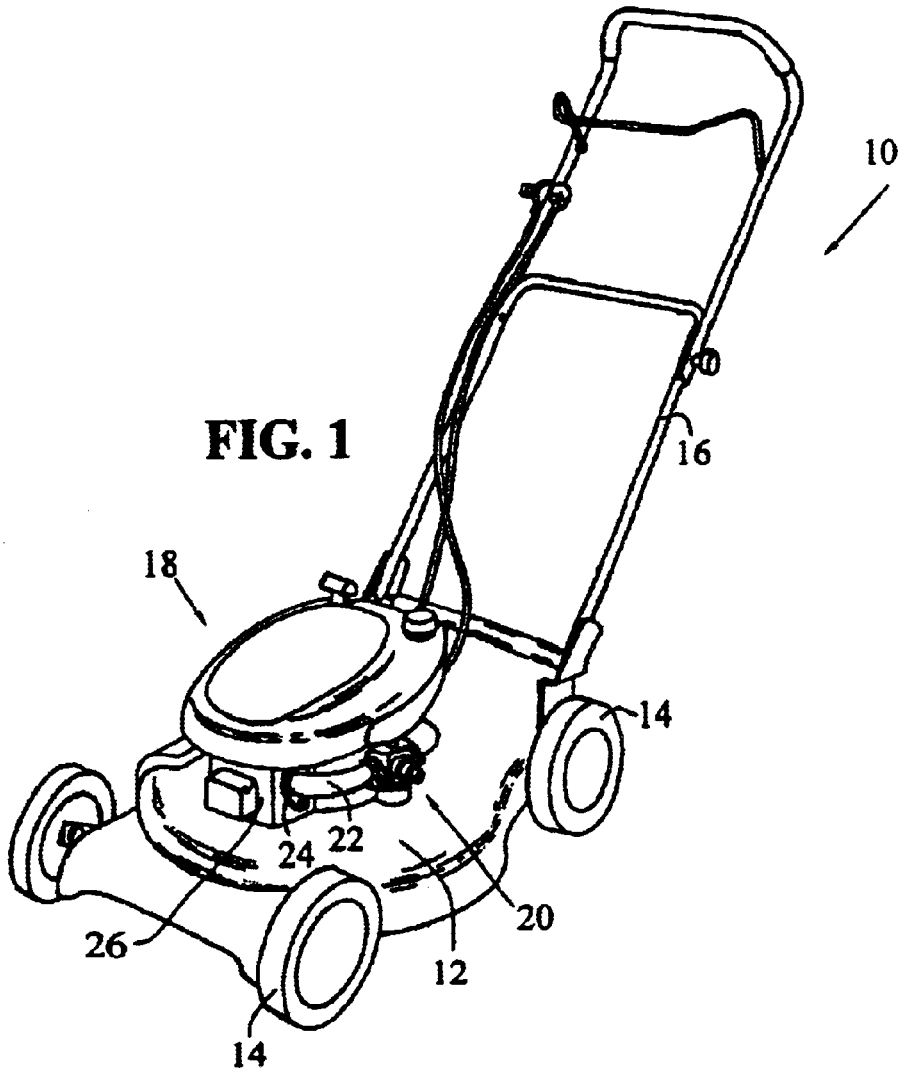
FIG. 1 is a perspective view of a lawnmower including a small internal combustion engine having a carburetor with a primer assembly in accordance with the present invention.

Referring to FIG. 1, lawnmower 10 is shown, including deck 12 having wheels 14, and handle 16 attached to deck 12. Additionally, lawnmower 14 includes internal combustion engine 18 mounted to deck 12, wherein the power take-off ("PTO") end of the engine crankshaft (not shown) is disposed vertically, and extends beneath deck 12 for driving connection to a blade (not shown). Engine 18 may be of any suitable type, such as a side valve or L-head engine, an overhead valve ("OHV") engine, or an overhead cam ("OHC") engine, for example. In particular, engine 18 may be a small single or twin-cylinder engine such as those disclosed in U.S. Pat. Nos. 6,276,234; 6,279,522; 6,295,959; and 6,499,453, each assigned to the assignee of the present invention, the disclosures of which are incorporated herein by reference.

Figure 2:
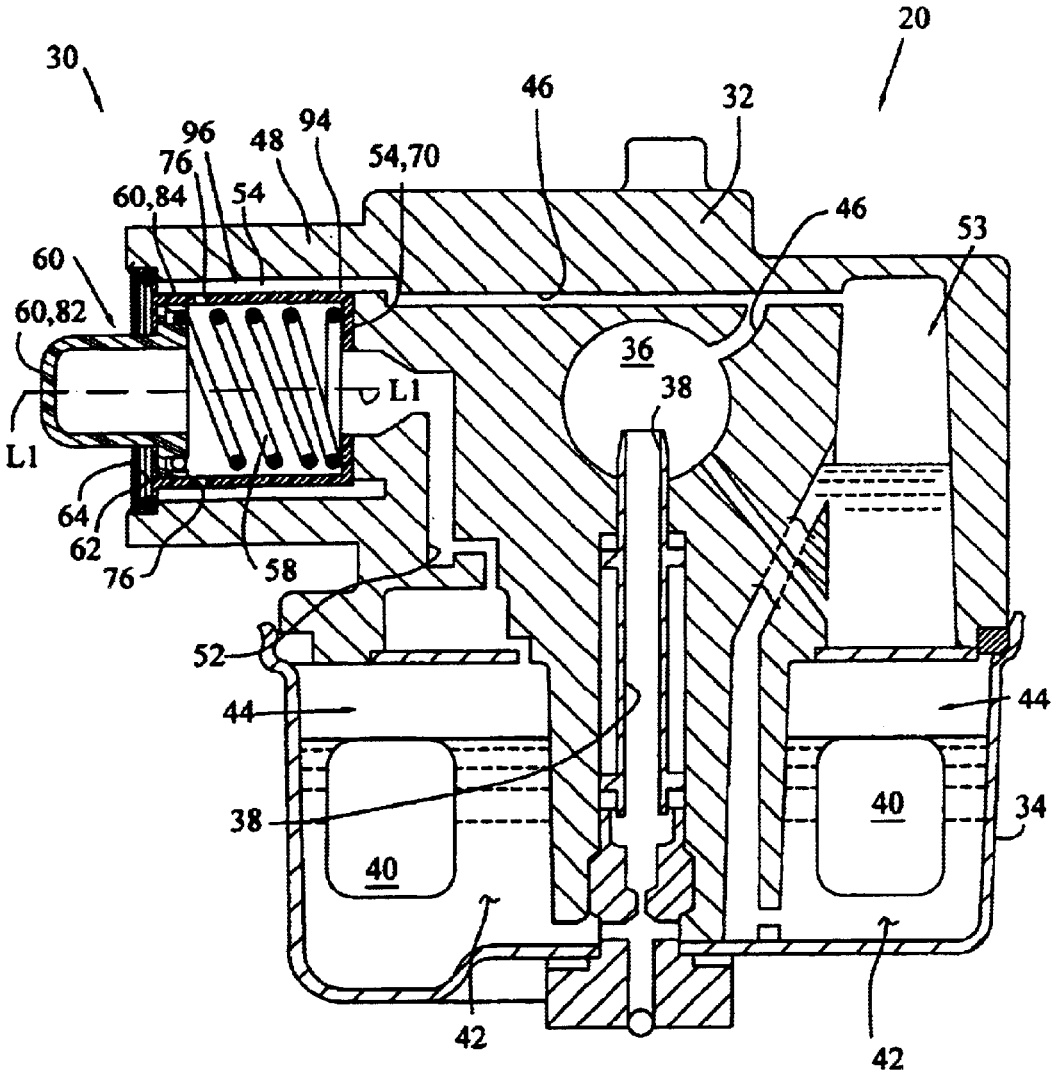
FIG. 2 is a sectional view of the carburetor of FIG. 1, including a primer assembly in accordance with the present invention.

Engine 18 additionally includes carburetor 20 attached thereto for supplying an air/fuel mixture to engine 18 via intake pipe 22 attached to intake port 24 of cylinder 26 of engine 18. Carburetor 20, as shown in FIG. 2, includes primer assembly 30, described in further detail below, for priming carburetor 20 to aid in starting engine 18. Although primer assembly 30 and carburetor 20 are shown in connection with engine 18 of lawnmower 10, it should be understood that primer assembly 30 may generally be used with a carburetors of any small internal combustion engine of the type used with lawnmowers, lawn tractors, sport vehicles, or other small working implements.

Referring to FIG. 2, carburetor 20 generally includes carburetor body 32 and fuel bowl 34 attached to carburetor body 32. Carburetor 20 includes many features similar to the carburetor disclosed in U.S. Pat. No. 6,152,431, assigned to the assignee of the present invention, the disclosure of which is expressly incorporated herein by reference. Carburetor body 32 includes throat 36 therethrough, having a venturi portion (not shown) disposed proximate main fuel jet 38, which extends from fuel bowl 34 into throat 36 to supply fuel to throat 36 in response to vacuum created at venturi portion of throat 36 during running of engine 18. Fuel bowl 34 includes a quantity of fuel therein, and also includes float 40 which floats on the fuel 42 within fuel bowl 34 and periodically actuates a valve (not shown) for metering a supply of fuel into fuel bowl 34 from a separate fuel tank (not shown). Air space 44 is defined within fuel bowl 34 above the fuel 42 therewithin, and is vented to the atmosphere via internal vent passage 46 which is connected to throat 36.

Figure 5:
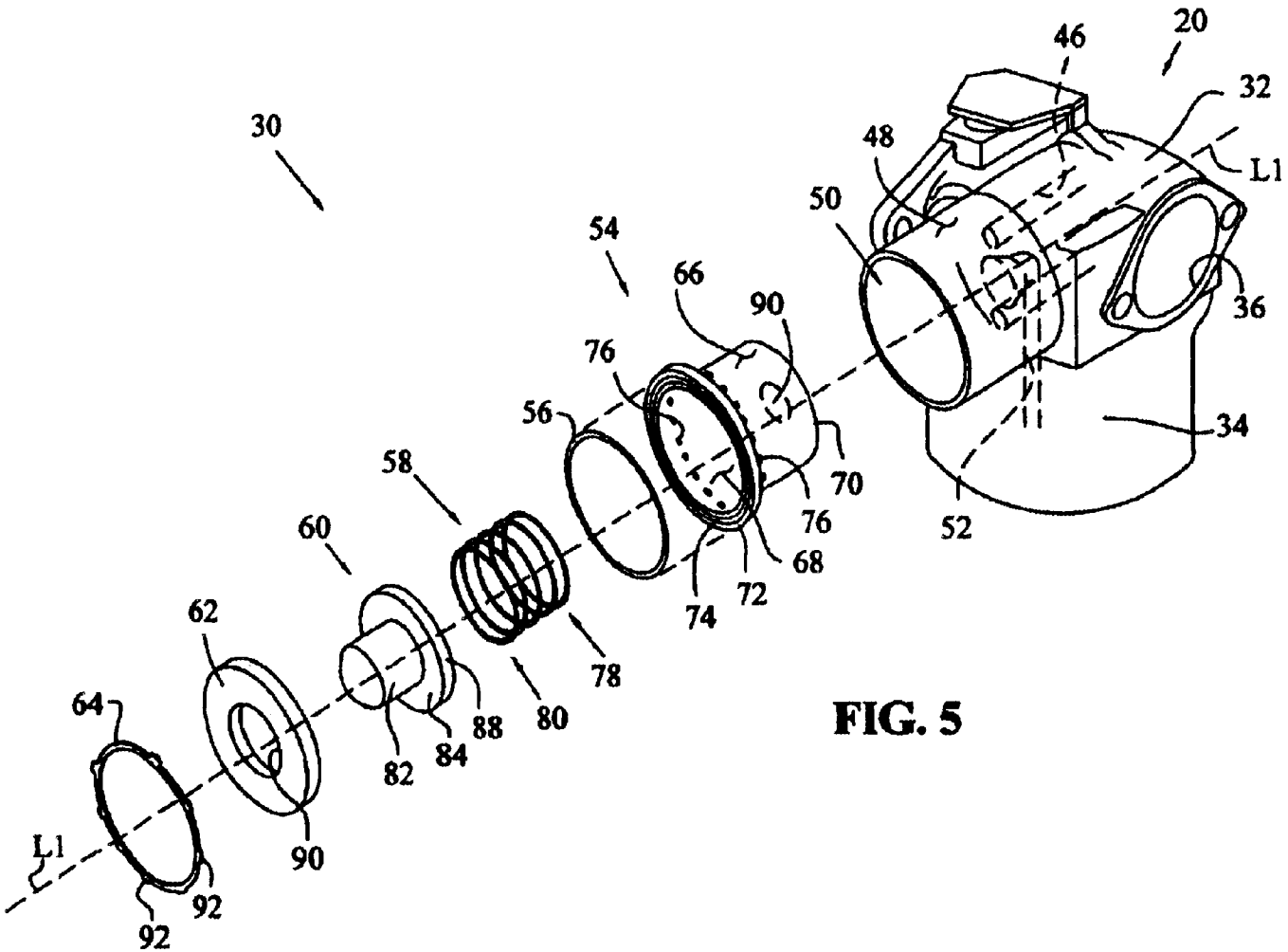
FIG. 5 is an exploded view of the carburetor of FIG. 2, showing the components of the primer assembly.

Referring additionally to FIG. 5, carburetor body 32 includes annular wall 48 projecting therefrom, which forms a recess or chamber 50 in carburetor body 32. Fuel bowl vent passage 52 communicates recess 50 with fuel bowl 34, and internal vent passage 46 communicates recess 50 with throat 36 and thereby to the atmosphere. Carburetor 20 additionally includes extended prime well 53, the operation of which is described in detail in the above-incorporated U.S. Pat. No. 6,152,431.

Referring to FIG. 5, the components of primer assembly 30 are shown, generally including sleeve 54, O-ring 56, return spring 58, piston 60, retaining ring 62, and lock ring 64, wherein the foregoing components are aligned along longitudinal axis $L_1$—$L_1$ of primer assembly 30. Sleeve 54 is annular in overall shape, and is made from metal or from a rigid or semi-rigid plastic material, for example, such as Celcon® M90, available from Ticona Inc., 90 Morris Ave., Summit, N.J. 07901. (Celcon® is a registered trademark of Celanese Corp., 522 5th Ave., New York, N.Y. 10036).

Sleeve 54 includes outer surface 66, inner surface 68, base wall 70 at one end thereof, and flange 72 at an end thereof opposite base wall 70. Flange 72 includes an annular recess 74 in which O-ring 56 is received. Sleeve 54 also includes a plurality of vent holes 76 which are spaced radially around sleeve 54 with respect to longitudinal axis $L_1$—$L_1$. As may be seen in FIG. 5, vent holes 76 are disposed in annular orientation radially around longitudinal axis $L_1$—$L_1$, and are positioned adjacent flange 72 of sleeve 54.

Return spring 58 is made from a suitable metal, and is shown herein as a helically coiled spring including first end 78 and second end 80.

Piston 60 is made from a substantially rigid plastic material such as Celcon® M90, available from Ticona Inc., 90 Morris Ave., Summit, N.J. 07901. (Celcon® is a registered trademark of Celanese Corp., 522 5th Ave., New York, N.Y. 10036). Piston 60 includes button portion 82 and flange portion 84 having annular recess 86 (FIGS. 3 and 4) therein for receipt of second end 90 of return spring 58, as discussed below. Flange portion 84 of piston includes outer sealing surface 88, which may include a lip formed from a material which is more resilient than the material from which the remainder of piston is made. Piston 60 is dimensioned to be closely received within sleeve 54, such that sealing surface 88 of piston 60 engages and slidably seals against inner surface 68 of sleeve 54 when piston 60 is inserted within sleeve 54.

Retaining ring 62 is made of a heavy gauge metal, for example, or from a rigid plastic material, and includes opening 90. Lock ring 64 is also made of a heavy gauge metal or from a rigid plastic material, and includes a plurality of locking tabs 92 spaced therearound.

Figure 3:
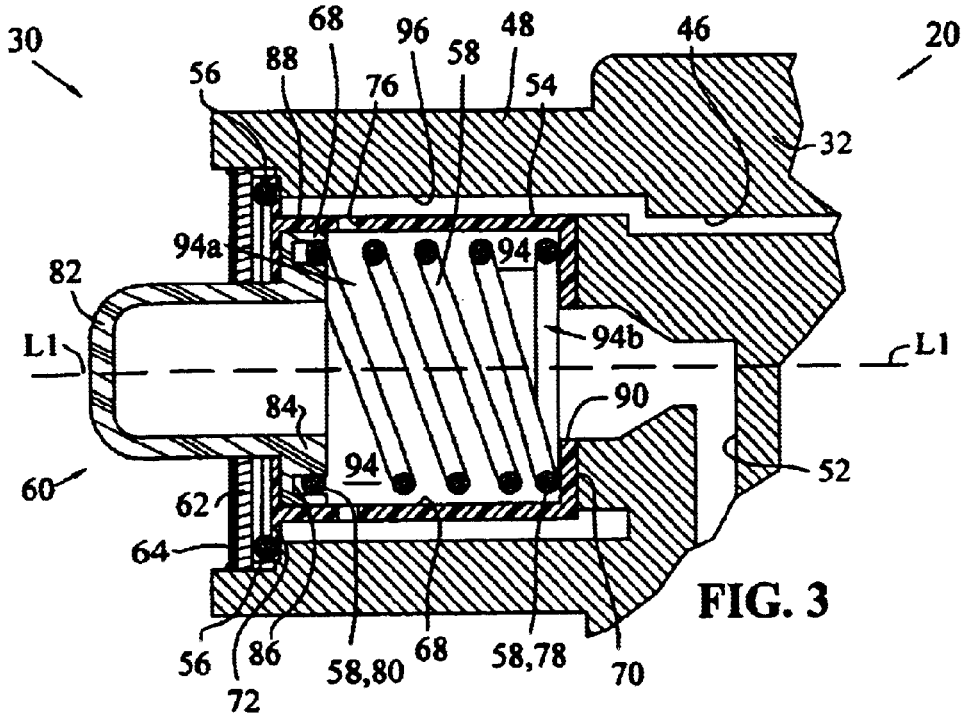
FIG. 3 is an enlarged fragmentary view of a portion of the carburetor of FIG. 2, showing the piston of the primer assembly in a first position.
Figure 4:
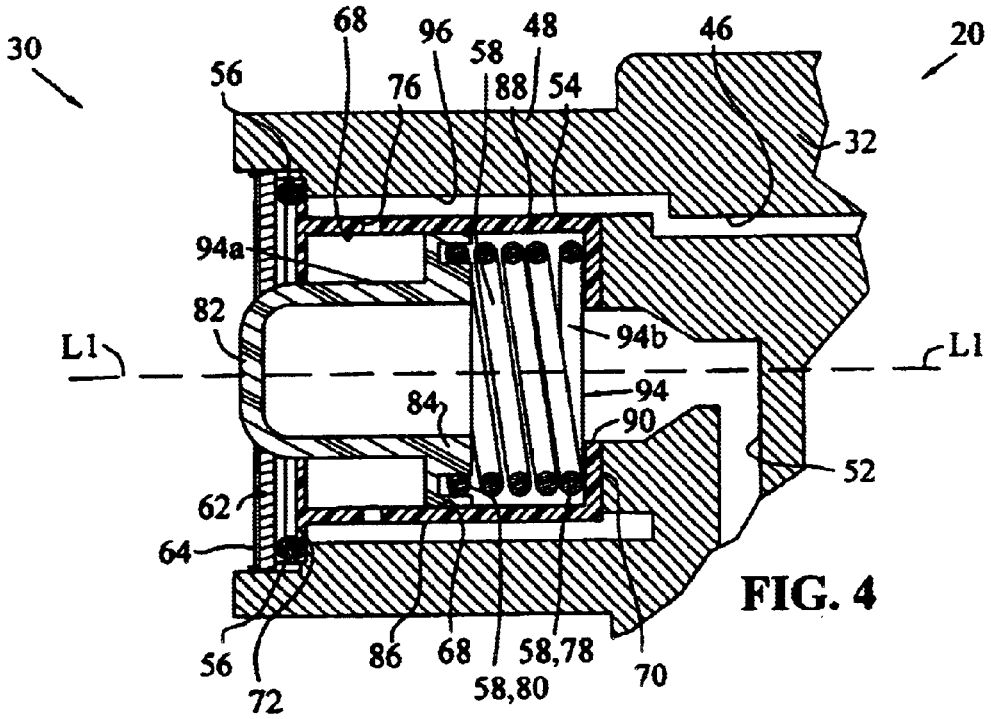
FIG. 4 is a enlarged fragmentary view of a portion of the carburetor of FIG. 2, showing the piston of the primer assembly in a second position.

Referring to FIGS. 3–5, primer assembly 30 is assembled by inserting sleeve 54 within recess 50 of carburetor 20 until base wall 70 of sleeve 54 abuts carburetor body 32. O-ring 56 is placed within annular recess 74 of flange 72 of sleeve 54, and return spring 58 is inserted within sleeve 54. Thereafter, piston 60 is inserted closely within sleeve 54, with first end 78 of return spring 62 abutting base wall 70 of sleeve 54, and second end 80 of return spring 62 received within annular recess 86 of flange 84 of piston 60. Retaining ring 62 is inserted over button portion 82 of piston 60, with button portion 82 closely received through opening 90 of retaining ring 62. The side of retaining ring 62 which faces piston abuts O-ring 56 to seal retaining ring 62 with flange 72 of sleeve 54. Finally, locking ring 64 is inserted within annular wall 48 of carburetor 20 and pressed therewithin, bending locking tabs 94 against annular wall 48 of carburetor 20 to capture the foregoing components of primer assembly 30 within recess 50 of carburetor 20.

Referring to FIG. 3, return spring 58 is held under compression between base wall 70 of sleeve 54 and flange portion of piston 60, and flange portion of piston 60 is in turn captured between second end 80 of return spring 58 and retaining ring 62, which limits outward travel of piston 60 along longitudinal axis $L_1$—$L_1$ in a direction away from carburetor 20. In the position of FIG. 3, button portion 82 of piston 60 projects outwardly of annular wall 48 of carburetor 20 such that same is accessible for depressing piston 60 to prime carburetor 20, as described in further detail below.

Primer chamber 94 is defined interiorly within sleeve 54 between base wall 70 thereof and piston 60, and includes proximal end 94*a* positioned outwardly with respect to carburetor 20, and distal end 94*b* positioned inwardly with respect to carburetor 20. Outer chamber 96 is a substantially annular space defined between annular wall 48 of carburetor 20 and outer surface 66 of sleeve 54. Outer chamber 96 is in communication with throat 36 of carburetor 20 via internal vent passage 46, and primer chamber 94 is in communication with outer chamber 96 through vent holes 76 in sleeve 54. Primer chamber 94 is also in communication with fuel bowl 34 of carburetor 20 through fuel bowl vent passage 52.

Normally, the components of primer assembly 30 are disposed as shown in FIGS. 2 and 3, in which return spring 58 biases piston 60 outwardly of carburetor 20 toward proximal end 94*a* of primer chamber 94 and to a position in which flange 84 of piston 60 is in abutment with retaining ring 62 and button portion 82 of piston 60 projects outwardly of carburetor 20 for access, as described above. Additionally, in this position, flange 84 of piston 60 is disposed outwardly of vent holes 76 of sleeve 54, such that primer chamber 94 is in communication with outer chamber 96 and internal vent passage 46 and thence to the atmosphere via throat 36, and primer chamber 94 is also in communication with fuel bowl 34 of carburetor 20 through fuel bowl vent passage 52. In this manner, air space 44 of fuel bowl 34 is at atmospheric pressure when engine 18 is at rest.

To prime carburetor 20 to aid in starting engine 18, a user places a finger on button portion 82 of piston 60 and depresses piston 60 inwardly against the bias of return spring 58 toward distal end 94*b* of primer chamber 94. Alternatively, an actuation mechanism (not shown) may be used to depress piston 60, wherein the actuation mechanism may be remotely actuated by a user. Piston 60 is constrained to move along longitudinal axis $L_1$—$L_1$ of primer assembly 30 due to the rigidity of piston 60 and sleeve 54, wherein piston 60 is closely received within sleeve 54 such that outer sealing surface 88 of flange 84 of piston 60 seals against inner surface 68 of sleeve 54. Further, the receipt of second end 80 of return spring 58 within annular recess 86 of flange 84 of piston 60 distributes the bias force of return spring 58 substantially evenly around flange 84, which aids in constraining piston 60 for travel along longitudinal axis $L_1$—$L_1$ of primer assembly 30. Advantageously, regardless of the direction from which button portion 82 of piston 60 is pressed from externally of carburetor 20, the constrained movement of piston 60 along longitudinal axis $L_1$—$L_1$ of primer assembly 30 facilitates correct operation of primer assembly 30, as described below.

During initial movement of piston 60 along the longitudinal axis $L_1$—$L_1$ inwardly toward carburetor 20, and toward distal end 94*b* of primer chamber 94, against the bias of return spring 58, flange 84 of piston 60 clears or passes inwardly beyond vent holes 76 of sleeve 54 to thereby sever or break communication between primer chamber 94 and outer chamber 96.

Thereafter, as shown in FIG. 4, further movement of piston 60 along longitudinal axis $L_1$—$L_1$ and against the bias of return spring 58 reduces the volume of primer chamber 94 and forces the air in primer chamber 94 through fuel bowl vent passage 52 into air space 44 of fuel bowl 32 to pressurize air space 44. Pressurization of air space 44 forces a quantity of liquid fuel 42 upwardly through main fuel jet 38 into throat 36 of carburetor 20 to "wet" throat 36, thus providing an enriched air/fuel mixture during initial cranking of engine 18 to aid in starting engine 18.

Inward movement of piston 60 toward carburetor 20 is eventually limited by the compression of return spring 58, as shown in FIG. 4. Thereafter, release of piston 60 allows return spring 58 to bias piston 60 outwardly along longitudinal axis $L_1$—$L_1$ in a direction away from carburetor 20, toward proximal end 94*a* or primer chamber 94, and back to the initial position shown in FIGS. 2 and 3. When flange 84 of piston 60 passes outwardly of vent holes 76 of sleeve 54, primer chamber 94 is again communicated with outer chamber 96 to allow atmospheric air from throat 36 of carburetor 20 into primer chamber 94 to equalize the pressure between throat 36 of carburetor 20 and air space 44 of fuel bowl 34. After engine 18 starts, reduction of pressure in throat 36 of carburetor 20 is communicated through internal vent passage 46, outer chamber 96, vent holes 76, primer chamber 94, and fuel bowl vent passage 52 to air space 44 of carburetor 20, such that air space 44 of carburetor 20 is at less than atmospheric pressure during running of engine 18.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A carburetor, comprising:

a carburetor body having a throat therethrough;

a fuel bowl containing a quantity of fuel, said fuel bowl in communication with said throat;

an internal vent passage in communication with said throat; and a primer assembly, comprising:

a primer chamber in communication with said internal vent passage through at least one vent hole disposed at a proximal end of said primer chamber, said primer chamber also in communication with said fuel bowl at a distal end of said primer chamber; and a piston slidable within said primer chamber, whereby initial travel of said piston closes said at least one vent hole, and further travel of said piston displaces air from said primer chamber into said fuel bowl.

2. The carburetor of claim 1, wherein said primer chamber includes a longitudinal axis, and said at least one vent hole is radially spaced from said longitudinal axis.

3. The carburetor of claim 2, wherein said piston is constrained within said primer chamber for slidable movement along said longitudinal axis.

4. The carburetor of claim 1, wherein said primer chamber includes an annular inner surface, said piston slidably engaging said inner surface.

5. The carburetor of claim 3, wherein said primer chamber is defined by an annular sleeve inserted within said carburetor, said annular sleeve having an outer surface.

6. The carburetor of claim 5, wherein an outer chamber is defined between said carburetor and said outer surface of said annular sleeve, said outer chamber in communication with said internal vent passage.

7. The carburetor of claim 6, wherein said annular sleeve includes a plurality of vent holes therein radially spaced about said longitudinal axis, said vent holes communicating said primer chamber and said outer chamber.

8. The carburetor of claim 1, further comprising a return spring disposed within said primer chamber, said return spring biasing said piston toward said proximal end of said priming chamber whereby said primer chamber is in communication with said internal vent passage through said at least one vent hole.

9. The carburetor of claim 8, wherein said piston includes an annular recess in which an end portion of said spring is received.

10. The carburetor of claim 1, including a fuel bowl vent passage communicating said primer chamber and said fuel bowl.

11. A carburetor, comprising:

a carburetor body having a throat;

a fuel bowl containing a quantity of fuel and an air space above said quantity of fuel, said fuel bowl in communication with said throat; and a primer assembly, comprising:

a primer chamber in communication with said fuel bowl air space;

vent means for communicating said primer chamber with said throat; and piston means for closing said vent means and forcing air from said primer chamber into said fuel bowl air space.

12. The carburetor of claim 11, wherein said piston means is sealingly movable within said primer chamber to vary the volume of said primer chamber.

13. The carburetor of claim 11, wherein said primer chamber includes a longitudinal axis, and said vent means comprises at least one opening in said primer chamber which is radially spaced from said longitudinal axis.

14. The carburetor of claim 13, wherein said vent means further comprises an internal vent passage communicating said at least one opening with said throat.

15. The carburetor of claim 13, wherein said piston means is constrained within said primer chamber for movement along said longitudinal axis.

16. The carburetor of claim 11, further comprising return means for biasing said piston means to a position in which said vent means is open.

17. The carburetor of claim 11, wherein said piston means includes means for retaining said return means.

18. The carburetor of claim 11, wherein said primer chamber is defined by an annular sleeve inserted within said carburetor, said annular sleeve having an outer surface.

19. The carburetor of claim 18, wherein an outer chamber is defined between said carburetor and said outer surface of said annular sleeve, said outer chamber in communication with said vent means.

20. The carburetor of claim 11, including a bowl vent passage communicating said primer chamber and said fuel bowl.

21. A method of priming a carburetor for starting an internal combustion engine, comprising the steps of:

depressing a piston assembly within a primer chamber in a direction from a proximal end to a distal end of the primer chamber to thereby move a portion of the piston assembly beyond a vent in the primer chamber to block communication between the primer chamber and an internal vent of the carburetor; and continuing depression of the piston assembly to force air within the primer chamber into a fuel bowl of the carburetor to pressurize the fuel bowl and thereby convey fuel from the pressurized fuel bowl to a throat of the carburetor.

* * * * *